US006500271B1

(12) United States Patent
Moore et al.

(10) Patent No.: US 6,500,271 B1
(45) Date of Patent: Dec. 31, 2002

(54) PIPELINE PIG

(76) Inventors: Darren Moore, Box 186, Turner Valley, Alberta (CA), T0L 2A0; Gerry Moore, 251 Millrise Drive, S.W., Calgary, Alberta (CA), T2Y 2S6; Jamie Magnusson, #7, Mount Aberdeen Manor, S.E., Calgary, Alberta (CA), T2Z 3N8; Chris Boase, 126 Harvest Oak View, N.E., Calgary, Alberta (CA), T3K 4Z6

( * ) Notice: Subject to any disclaimer, the term of this patent is extended or adjusted under 35 U.S.C. 154(b) by 177 days.

(21) Appl. No.: 09/631,120

(22) Filed: Aug. 2, 2000

(51) Int. Cl.[7] ..... B08B 1/00; B08B 9/055
(52) U.S. Cl. ..... 134/8; 15/104.061
(58) Field of Search ..... 15/3.5, 3.51, 104.061; 134/8; 446/15, 18, 21, 267, 176, 180

(56) References Cited

U.S. PATENT DOCUMENTS

| | | | | |
|---|---|---|---|---|
| 616,696 | A | * | 12/1898 | Cochran |
| 646,545 | A | | 4/1900 | Novotny |
| 2,764,565 | A | | 9/1956 | Hoppe et al. |
| 3,011,197 | A | | 12/1961 | Nehse et al. |
| 3,543,323 | A | | 12/1970 | Girard |
| 3,651,530 | A | | 3/1972 | Schultz |
| 3,863,287 | A | | 2/1975 | Knapp et al. |
| 4,003,393 | A | * | 1/1977 | Jaggard |
| 4,242,771 | A | | 1/1981 | Knapp |
| 4,244,073 | A | | 1/1981 | Sagawa |
| 4,406,031 | A | | 9/1983 | Eimer |
| 4,592,417 | A | * | 6/1986 | Baron |
| 5,150,493 | A | | 9/1992 | Sivacoe |
| 5,924,158 | A | | 7/1999 | Watts |

FOREIGN PATENT DOCUMENTS

| | | | |
|---|---|---|---|
| DE | 522895 | * | 4/1931 |
| DE | 1953017 | * | 4/1971 |
| GB | 2217423 | * | 10/1989 |
| JP | 6-273091 | * | 9/1994 |
| SU | 0662168 | * | 5/1979 |

* cited by examiner

*Primary Examiner*—Randall E. Chin
(74) *Attorney, Agent, or Firm*—I. Zborovsky

(57) ABSTRACT

A pipeline pig for removing scales and debris from the interior walls of a pipeline has a generally cylindrical central portion with a hollow core and a rounded end on each two ends of the cylindrical central portion, is produced of a flexible material to facilitate the movement of the pipeline pig through non-linear sections of a pipeline and buildups of scale and debris in a pipeline, has a solution which fills the hollow core, and includes a body which is formed as a peripheral fluid closed body composed of the flexible material.

5 Claims, 4 Drawing Sheets

PIPELINE PIG

BACKGROUND OF THE INVENTION

1. Field of the Invention

The present invention relates to the refinery industry and the removal of buildups of scale on the interior walls of refinery pipelines and furnaces produced by the refining of hydrocarbons. More particularly, the invention comprises a pipeline pig, a device with metallic scrapers for removing the built up scale from the interior walls of pipelines and furnace pipes.

2. Description of the Prior Art

In the petroleum refining process, lengths of furnace pipeline are heated in order to separate the various hydrocarbons into various petroleum products. In this separation process, the internal walls of furnace pipes become encrusted with baked on scale, restricting the flow rate and overheating the furnace pipelines. For years, steam "decoking" has been the normal procedure for removing these scale buildups by blasting super heated steam through the pipelines to thermally crack the scale buildup, followed by washing with water to flush the loosened deposits from the pipeline. This steam decoking process, however, presents a number of potential problems, including potential damage to the pipeline from overheating or over pressurization, and releasing environmentally unsafe vapors when the steam is vented. Use of a pipeline pig would resolve many of these problems.

Over the past century, a number of different pipeline pigs have been developed for cleaning the interior of pipelines.

U.S. Pat. No. 646,545, issued to Franz Novotny on Apr. 3, 1900, relates to an apparatus for scouring and cleaning pipes or conduits, consisting of three distinct elements. The first element is a parabolic piston of a slightly smaller diameter than the pipe to be cleaned, which, when forced under pressure through the pipe pulls a second element of the device which is covered with scrapers for loosening any buildup. The scraper, in turn, pulls a wire brush which scours the pipe walls to further remove any buildup. The entire device is restrained against the pressure flow by a trailing guide line, with which it may be retrieved. The present invention is designed for the heat and pressure of refinery pipelines and provides additional flexibility in the pipeline pig's composition to allow for sharper bends in the pipelines being cleaned.

U.S. Pat. No. 3,011,197, issued to Ulrich Nehse, et. al., on Dec. 5, 1961 and U.S. Pat. No. 5,343,323, issued to Harry J. Girard on Dec. 1, 1970, relate to pipeline cleaning devices constructed of polyurethane, wherein a harder outer surface covers a more resilient and flexible core. Nehse presents a generally spherical device while Girard a generally bullet shaped device. In both Nehse and Girard, scrubbing action is by friction between the polyurethane surface and the scale on the pipe. The present invention offers metallic scrapers for additional cutting action against buildups on pipe surfaces.

U.S. Pat. No. 3,651,530, issued to Ronald W. Schultz on Mar. 28, 1972 relates to a pipeline cleaning device constructed of a resiliently deformable material, generally spherical in shape, with a plurality of protuberances from its general surface providing scrubbing action. The protuberances are composed of the same material as the sphere, formulated to a greater hardness than the sphere. The present invention offers metallic scrapers for additional cutting action against buildup on pipe surfaces.

U.S. Pat. No. 3,863,287, issued to Kenneth M. Knapp, et. al., on Feb. 4, 1975, relates to a pipeline pig, generally bullet shaped, in which a polyurethane outer shell cast over an inner bladder of a resilient material, such that the outer shell can be replaced when worn down. Scrubbing action is provided by the edges of diamond shaped recesses in the surface of the outer shell. The present invention, again, offers metallic scrapers for additional cutting action against buildups.

U.S. Pat. No. 4,406,031, issued to Klaus Eimer, et. al., on Sep. 27, 1983 relates to a device for cleaning the interior of heat exchanger tubes. Eimer is composed of a sponge rubber ball with a plurality plastic bristles protruding from its surface for the cleaning of relatively small bore pipes. By contrast, the present invention is composed of a denser, more heat resistant rubber compound and provides metallic scrapers for additional cutting action against buildups.

U.S. Pat. No. 4,242,771, issued to Kenneth M. Knapp on Jan. 6, 1981; U.S. Pat. No. 4,244,073, issued to Sizuo Sagawa on Jan. 13, 1981; U.S. Pat. No. 5,150,493, issued to Edward L. Roberts on Sep. 29, 1992; and U.S. Pat. No. 5,924,158, issued to Robert C. Watts on Jul. 20, 1999, each refer to pipeline pigs generally cylindrical or bullet shaped, each with metallic studs protruding from a resilient body. The metallic studs provide increased cleaning ability over the polyurethane of the previously cited examples. Knapp, Sagawa, Roberts, Watts offer improvements over the cleaning ability of previous inventions, but, unlike the present invention, they fail to address the other major problem with pipeline pigs, that of becoming irretrievably stuck in a pipe. In order to avoid cutting the pipe to retrieve an irretrievable stuck pipeline pig, pipeline pigs composed entirely of polyurethane, or other polycarbonates, can often be melted by the application of external heat to the pipeline if they become stuck. By the introduction of metals into their composition, however, melting could tend to cause the studs to separate from the pipeline pig and fall into the pipeline. The present invention provides a preferable method of retrieval through its pressure release valves which allow the liquid/gel within the core of a stuck pipeline pig to escape, reducing the pressure the pipeline pig exerts against the internal surface of the pipeline.

None of the above inventions and patents, taken either singly or in combination, is seen to describe the instant invention as claimed.

SUMMARY OF THE INVENTION

In the petroleum refining process, lengths of furnace pipeline are heated in order to separate the various hydrocarbons into various petroleum products. In this separation process, the internal walls of furnace pipes become encrusted with baked on scale, restricting the flow rate and overheating the furnace pipelines. For years, steam "decoking" has been the normal procedure for removing these scale buildups by blasting super heated steam through the pipelines to thermally crack the scale buildup, followed by washing with water to flush the loosened deposits from the pipeline. This steam decoking process, however, presents a number of potential problems, including potential damage to the pipeline from overheating or over pressurization, and releasing environmentally unsafe vapors when the steam is vented. Use of a pipeline pig would resolve many of these problems, but existing pipeline pigs often present even more problems. Under heavy scaling conditions, the pipeline pig often gets stuck in the pipeline and pressure must be increased in an attempt to free the pipeline pig. This process often requires pressures in excess of manufacturer's recommendations, occasionally causing blow outs of the pipeline, causing damage and/or personal injury. Alternatively, the pipeline must be cut to remove a stuck pipeline pig. Additionally, the placement of scrapers around the perimeter of many pipeline pigs is such that they do not cover the entire circumference of the pipe, leading to tracking in the scale, with each successive pipeline pig tending to follow the same tracks, eventually causing damage to the interior of the pipe.

Accordingly, it is a principal object of the invention to provide a pipeline pig which is economical to use.

It is another object of the invention to provide a pipeline pig which is easily removable if it becomes stuck in a pipeline.

It is a further object of the invention to provide a pipeline pig which provides effective cleaning of the full perimeter of the interior walls of a pipeline.

Still another object of the invention is to provide a pipeline pig which can be used in a variety of sizes of pipe.

An additional object of the invention is to provide a pipeline pig which can be used in a variety of types of pipes.

It is an object of the invention to provide improved elements and arrangements thereof in an apparatus for the purposes described which is inexpensive, dependable and fully effective in accomplishing its intended purposes.

Still another object of the invention is to provide a pipeline pig which can easily navigate sharper bends in pipelines.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
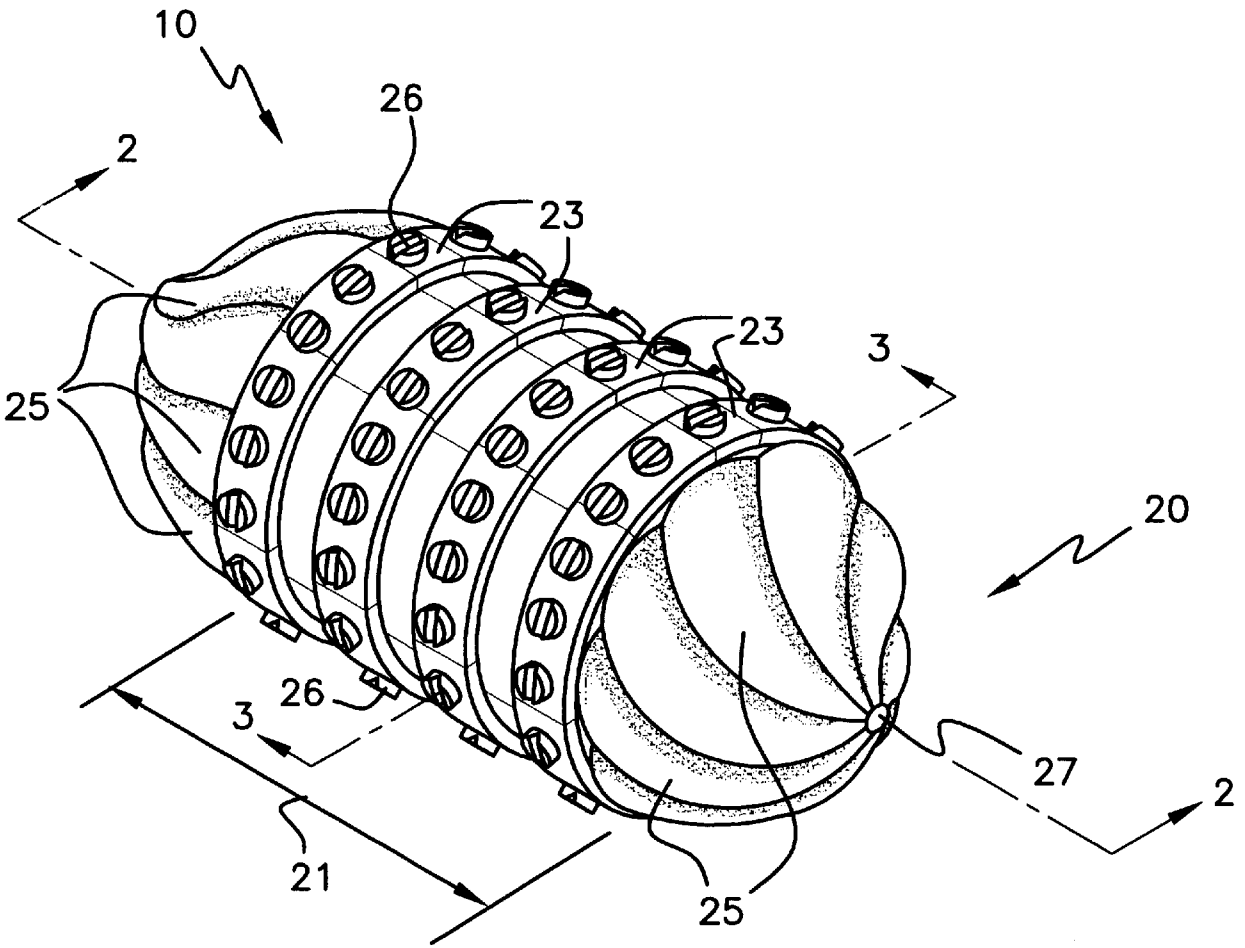
FIG. 1 is an environmental perspective view of the invention.

FIG. 1 shows pipeline pig 10, having a generally cylindrical central portion 21, with a plurality of evenly spaced, concave ridges 25 tapering from each end of central portion 21 in a rotational pattern, joining to form rounded ends 20. Pressure release valves 27 are located at the confluence of concave ridges 25 in each rounded end 20. A plurality of protruding ribs 23, an integral part of central portion 21, are evenly spaced, encircling central portion 21. The body 28, FIG. 3, of pipeline pig 10 is constructed of a flexible material, preferably a polyurethane rubber-like material, with pressure release valves 27 constructed of a thinner layer of the same material. A plurality of metallic scrapers 26 are evenly spaced along the length of each protruding rib 23 and set into protruding ribs 23. To ensure complete cleaning of the pipeline, metallic scrapers 26 of each succeeding protruding rib 23 are offset such that they are situated half way between the metallic scrapers 26 of the preceding protruding rib 23.

Figure 3:
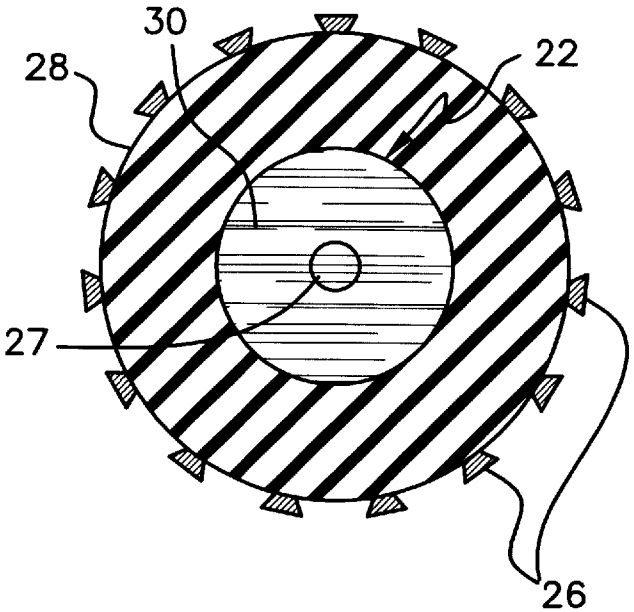
FIG. 3 is a lateral cross section of the invention at line 3—3 of FIG. 1.
Figure 2:
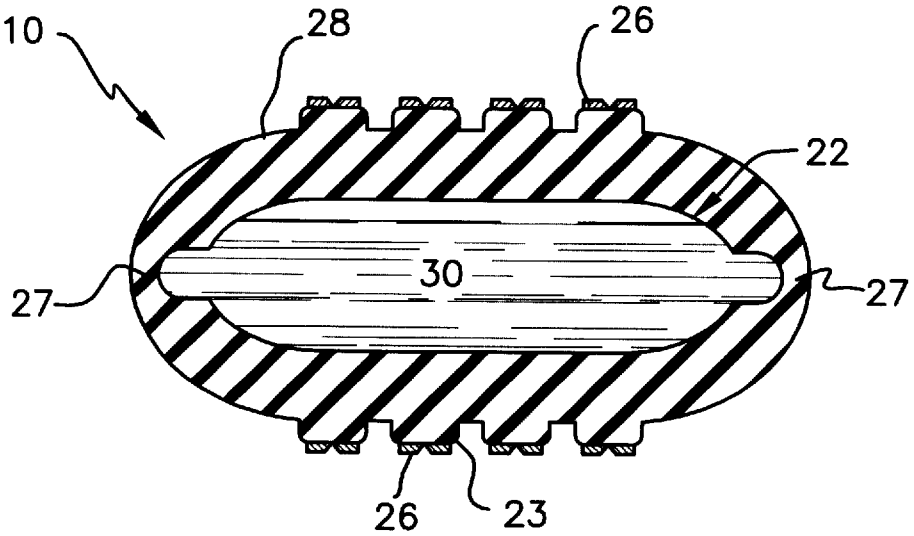
FIG. 2 is a longitudinal cross section of the invention at line 2—2 of FIG. 1.

FIG. 2 and FIG. 3 display pipeline pig 10 in cross section, showing the fluid/gel 30 filled core 22 and pressure release valves 27.

Figure 4:
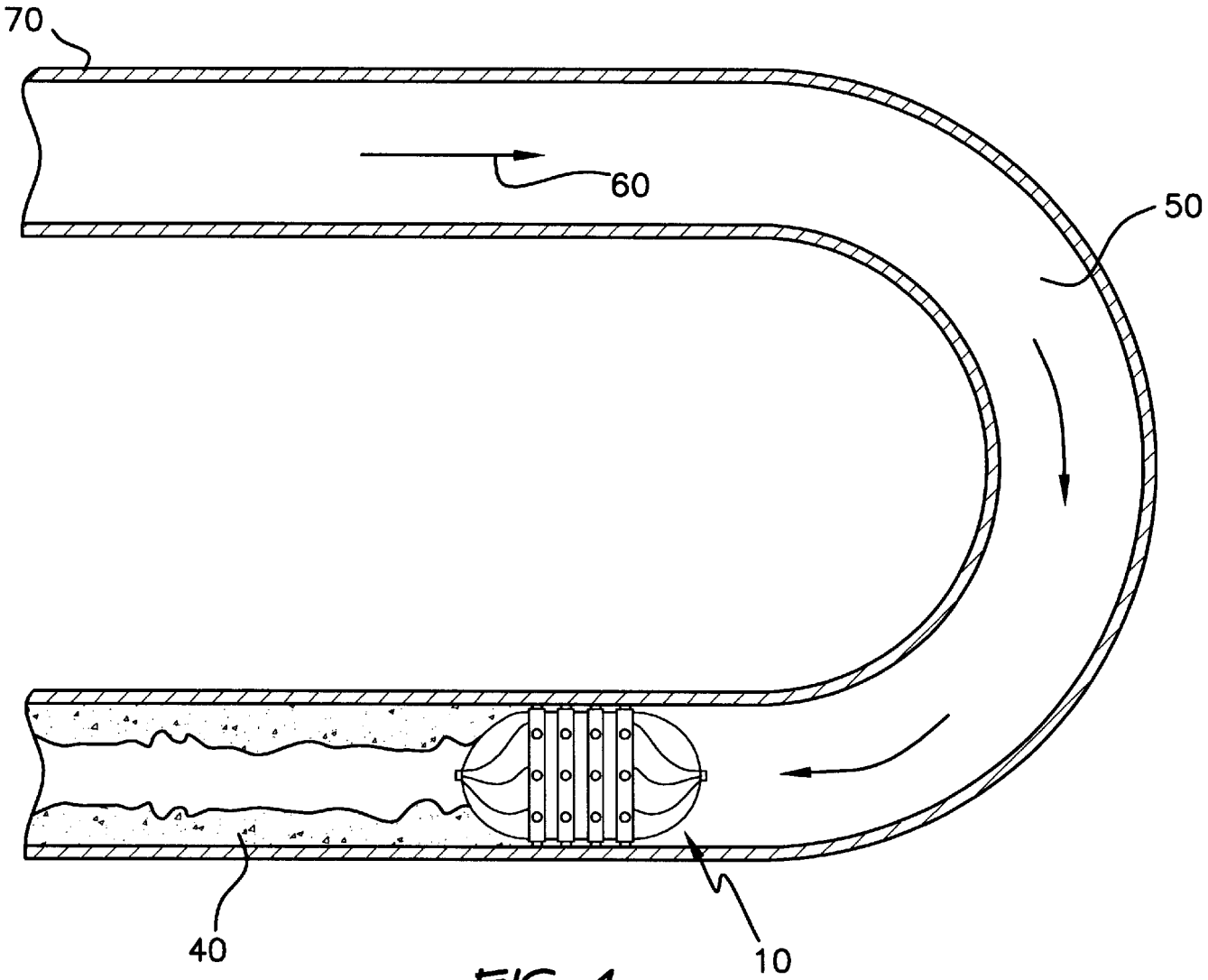
FIG. 4 is a view of the invention as it travels though a pipeline.

In FIG. 4, pipeline pig 10 traveling through pipeline 70, propelled by motivational fluid 60, as it engages scale buildup 40. The flexibility of the polyurethane body of pipeline pig 10 allows pipeline pig 10 to navigate non-linear sections 50 of pipeline 70.

Figure 5:
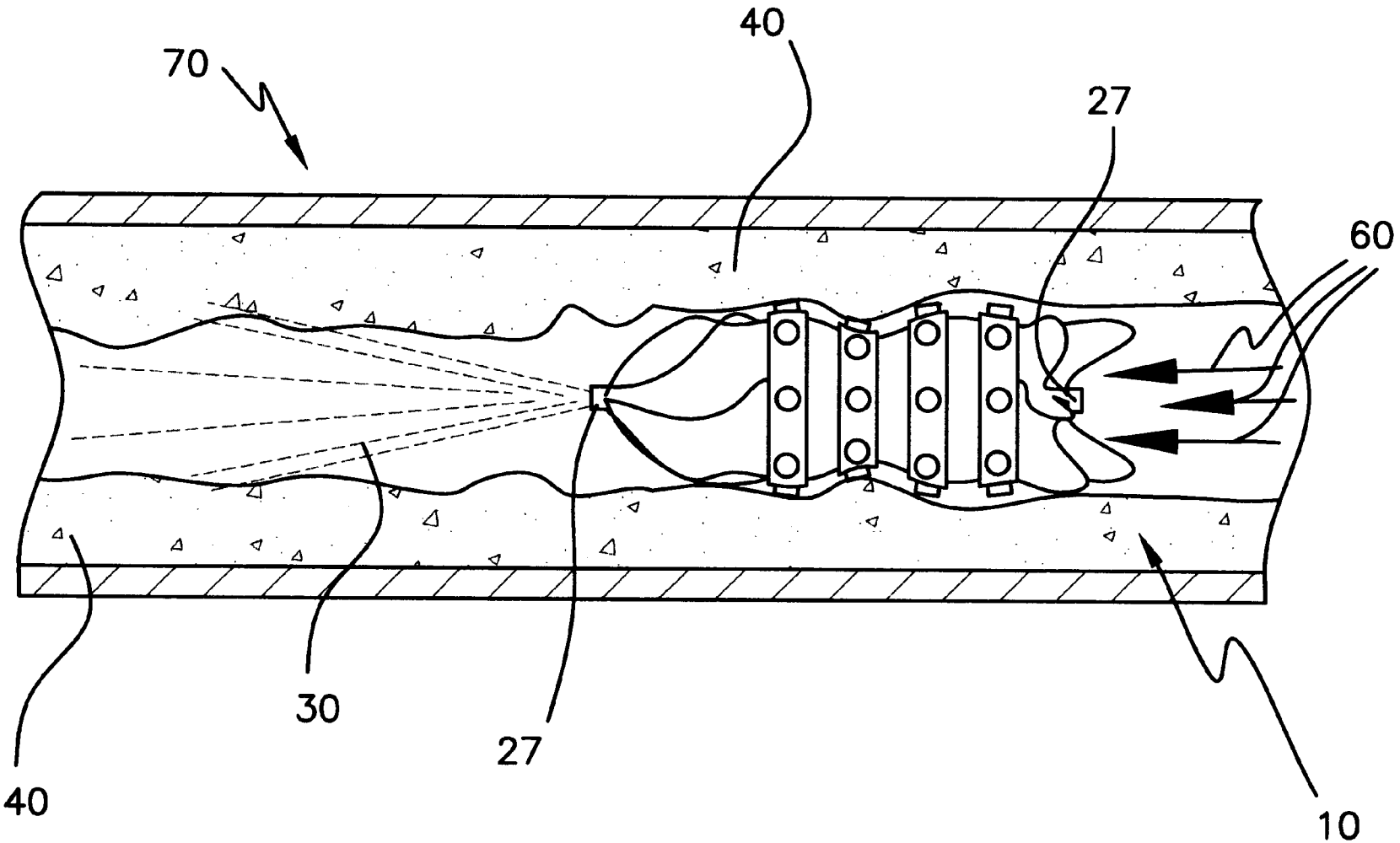
FIG. 5 is a view of the invention caught in a pipeline with excessive scale.

In FIG. 5, shows pipeline pig 10 caught in an excessive buildup of scale 40, unable to proceed further through pipeline 70. As the pressure of motivational fluid 60 increases due to the blockage created by pipeline pig 10's inability to proceed causes pressure release valves 27 to rupture, allowing the fluid/gel 30 contained in core 22 (not shown) to escape into pipeline 70. With the release of internal pressure, pipeline pig 10 collapses, freeing it from the buildup of scale 40, allowing pipeline pig 10 to be flushed from pipeline 70.

In its preferred application, pipeline pig 10 is introduced into pipeline 70 such that protruding ribs 23 are in contact with the inner walls of pipeline 70. Under pressure, motivational fluid 60 forces pipeline pig 10 forward through pipeline 70 such that metallic scrapers 26 in protruding ribs 23 scrape scales 40 buildups from the internal walls of pipeline 70. The spiral shape of concave ridges 25 give pipeline pig 10 the tendency to rotate as it travels through pipeline 70, increasing the possibility that the entire perimeter of pipeline 70 is scraped by metallic scrapers 26. Pipeline pig 10, being made of a flexible material, is able to navigate relatively sharp bends in pipeline 70 and buildups of scale in the pipeline. If pipeline pig 10 becomes lodged in an excessive buildup of scale 40, the pressure on motivational fluid 60 increases until a) pipeline pig 10 is deformed and forced through the restriction caused by the excessive buildup of scale 40, or b) pressure release valves 27 in pipeline pig 10 rupture, allowing the fluid/gel 30 contained in core 22 to escape into pipeline 70. With the release of internal pressure, pipeline pig 10 collapses slightly, freeing it from the buildup of scale 40, allowing pipeline pig 10 to be flushed from pipeline 70.

It would be evident to one skilled in the art that pipeline pig 10 could be produced of a variety of different flexible materials. It would also be evident to one skilled in the art that metallic scrapers 26 could be of a number of different designs and composition. It would further be evident that pipeline pig 10 could be produced in a variety of different dimensions for use in pipelines of varying diameters. It would be further evident to one skilled in the art that pipeline pig 10 could be used in pipelines for a variety of different uses. Likewise, it would be evident to one skilled in the art that hollow core 22 could be filled with a number of different liquids or gels, as well as air or a gas.

It is to be understood that the present invention is not limited to the embodiments described above, but encompasses any and all embodiments within the scope of the following claims.

We claim:

1. A pipeline pig for removing scale and debris from the interior walls of a pipeline, comprising;

a generally cylindrical central portion, having a hollow core and a rounded end on each of two ends of said cylindrical central portion, said pipeline pig being produced of a flexible material to facilitate the movement of said pipeline pig through non-linear sections of a pipeline and buildups o f scale and debris in a pipeline, and said hollow core being filled with a solution said pipeline pig having a body which is completely peripherally closed and formed as a one-piece body composed as a whole of said flexible material.

2. A pipeline pig for removing scale and debris from the interior walls of a pipeline, comprising;

a generally cylindrical central portion, having a hollow core and a rounded end on each of two ends of said cylindrical central portion, said pipeline pig being produced of a flexible material to facilitate the movement of said pipeline pig through non-linear sections of a pipeline and buildups of scale and debris in a pipeline, and said hollow core being filled with a solution selected from the group consisting of a fluid solution and a gel solution, said cylindrical central portion having a plurality of evenly spaced protruding ribs, produced of said flexible material, raised around the circumference thereof, said protruding ribs providing an increased diameter over that of said cylindrical center portion so as to reduce the surface area in contact with the interior walls of a pipeline, and each protruding rib having a plurality of evenly spaced metallic scrapers disposed along the length of said protruding rib and projecting from the outer surface of said protruding rib, said metallic scrapers intended to scrape buildups of scale and debris from the interior surface of a pipeline, and said rounded ends having a plurality of evenly spaced concave ridges, produced of said flexible material, tapering from each of said two ends of said central portion in a rotational pattern, joining at a common point to form said rounded ends, said tapering concave ridges providing a tendency to rotate as said pipeline pig travels through a pipeline.

3. A pipeline pig, as defined in claim 2, wherein said metallic scrapers of each succeeding of said protruding ribs are offset such that said metallic scrapers are laterally situated half way between said metallic scrapers of the preceding of said protruding ribs to ensure thorough scraping of the interior surface of a pipeline, and said hollow core extends into said rounded ends such that said flexible material of which said pipeline pig is produced is thinner at said rounded ends than in said central portion, creating a pressure release valve in each of said rounded ends, said pressure release valves intended to blow out should said pipeline pig become stuck in a pipeline and pressure build up behind said pipeline pig, releasing said solution from said hollow core, allowing said pipeline pig to collapse slightly, freeing said pipeline pig from entrapment within a pipeline.

4. A pipeline pig for removing scale and debris from the interior walls of a pipeline, comprising;

a generally cylindrical central portion, and having a hollow core filled with a solution s elected from the group consisting of a fluid solution and a gel solution, and a plurality of evenly spaced protruding ribs raised around the circumference thereof, said protruding ribs providing an increased diameter over that of said cylindrical center portion so as to reduce the surface area in contact with the interior surface of a pipeline, and each protruding rib having a plurality of evenly spaced metallic scrapers disposed along the length of said protruding rib and projecting from the outer surface of said protruding rib, said metallic scrapers intended to scrape buildups of scale and debris form the interior surface of a pipeline, and said metallic scrapers of each succeeding of said protruding ribs are situated such that said metallic scrapers are laterally situated half way between said metallic scrapers of the preceding of said protruding ribs to ensure more thorough scraping of the interior surfaces of a pipeline; and a rounded end on each of two ends of said cylindrical central portion, having a plurality of evenly spaced concave ridges tapering from each of said two ends of said central portion in a rotational pattern, joining at a common point to form said rounded ends, said tapering concave ridges providing the tendency to rotate as said pipeline pig travels through a pipeline, and a pressure release valve in each of said rounded ends, said pressure release valves being formed by said hollow core being extended into said rounded ends such that said flexible material of which said pipeline pig is produced is thinner at said rounded ends than in said central portion, said pressure release valves intended to blow out should said pipeline pig become stuck in a pipeline and pressure build up behind said pipeline pig, freeing said solution from said hollow core, allowing said pipeline pig to collapse slightly, freeing said pipeline pig from entrapment within the pipeline, said cylindrical central portion, protruding ribs and rounded ends being produced of a flexible material to facilitate travel through non-linear sections of a pipeline and buildups of scale and debris in a pipeline.

5. A method for removing scale and debris from the interior walls of a pipeline, comprising the steps of;

a) placing a pipeline pig inside of a pipeline, wherein said pipeline pig comprises;

a generally cylindrical central portion produced of a flexible material to facilitate travel through non-linear sections of a pipeline and buildups of scale and debris in a pipeline, having a hollow core and a plurality of evenly spaced protruding ribs, produced of said flexible material, raised around the circumference thereof, said protruding ribs providing an increased diameter over that of said cylindrical central portion so as to reduce the surface are in contact with the interior surface of a pipeline, each protruding rib having a plurality of evenly spaced metallic scrapers disposed along the length of said protruding rib and projecting from the outer surface of said protruding rib, said metallic scrapers intended to scrape buildups of scale and debris form the interior surface of a pipeline, and said metallic scrapers of each succeeding of said protruding ribs are situated such that said metallic scrapers are laterally situated half way between said metallic scrapers of the preceding of said protruding ribs to ensure more thorough scraping of the interior surface of a pipeline; and a rounded end, produced of said flexible material, on each of two ends of said cylindrical central portion, having a plurality of evenly spaced concave ridges tapering from each of said two ends of said central portion in a a rotational pattern, joining at a common point to form said rounded ends, said tapering concave ridges providing a tendency to rotate as said pipeline pig travels through a pipeline, and a pressure release valve in each of said rounded ends, said pressure release valves being formed by said hollow core being extended into said rounded ends such that said flexible material of which said pipeline pig is produced is thinner at said rounded ends than in said central portion, said pressure release valve intended to blow out should said pipeline pig become stuck in a pipeline and pressure build up behind said pipeline pig, freeing said pipeline pig from entrapment within the pipeline, said hollow core being filled with a solution selected from the group consisting of a fluid solution and a gel solution;

b) introducing a motivational fluid into said pipeline, under pressure, c) said motivational fluid causing said pipeline pig tending to travel through said pipeline with a rotating motion due to said tapering of said concave ridges, d) said metallic scrapers scraping the scale from said interior walls of said pipeline, the loosened scale then being carried by said motivational fluid to a point in said pipeline where said pipeline pig and loosened scale can be removed; further, e) should said pipeline pig become stuck in an excessive buildup of said scale in said pipeline, said pressure on said motivational fluid could be increased until one of the following occurs;

1) said pipeline pig is forced free from said excessive buildup 2) said pressure release valves in said pipeline pig rupture, allowing said fluid/gel contained in said core to escape into said pipeline, allowing said pipeline pig to collapse slightly, freeing said pipeline pig from the excessive buildup of scale such that said pipeline pig can again be moved by said motivational fluid.

* * * * *